US006883983B2

(12) United States Patent
Kobayashi

(10) Patent No.: US 6,883,983 B2
(45) Date of Patent: Apr. 26, 2005

(54) PAPER LATERAL EDGE DETECTOR FOR PRINTER

(75) Inventor: Shigeto Kobayashi, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/751,633

(22) Filed: Jan. 6, 2004

(65) Prior Publication Data

US 2004/0145717 A1 Jul. 29, 2004

(30) Foreign Application Priority Data

Jan. 21, 2003 (JP) ..... 2003-012752

(51) Int. Cl.[7] ..... B41J 7/700; B41J 5/30; B41J 2/435

(52) U.S. Cl. ..... 400/408; 400/409; 400/61; 347/262; 347/264; 347/234

(58) Field of Search ..... 400/708, 709, 400/61; 348/316; 257/229; 347/262, 264; 247/234

(56) References Cited

U.S. PATENT DOCUMENTS 4,293,877 A * 10/1981 Tsunekawa et al. ..... 348/316
5,115,124 A * 5/1992 Muto et al. ..... 250/214 L
5,117,270 A * 5/1992 Toda ..... 257/76
5,270,787 A * 12/1993 Shofner et al. ..... 356/429
5,568,172 A * 10/1996 Cowger ..... 347/19
5,900,649 A * 5/1999 Effelsberg ..... 257/81
6,115,146 A * 9/2000 Suzuki et al. ..... 358/474
6,634,820 B2 * 10/2003 Kobayashi et al. ..... 400/709
6,667,468 B2 * 12/2003 Kurosawa et al. ..... 250/208.1
6,671,003 B1 * 12/2003 George et al. ..... 348/745
6,737,629 B2 * 5/2004 Nixon et al. ..... 250/214 C

FOREIGN PATENT DOCUMENTS

JP 09-272217 A 10/1997

* cited by examiner

*Primary Examiner*—Daniel J. Colilla
*Assistant Examiner*—Wasseem H. Hamdan
(74) *Attorney, Agent, or Firm*—Sughrue Mion, PLLC

(57) ABSTRACT

First and second light receiving windows are formed on a head cover of a thermal head. The first light receiving windows are disposed to cross the lateral edges of the first king-sized recording paper. The second light receiving windows are disposed to cross the lateral edges of the second large-sized recording paper. First and second phototransistors are provided on the thermal head so as to measure quantity of light passed through the first and second light receiving windows. When printing the first recording paper, the first light receiving windows are partially shielded with lateral edges of the first recording paper and the second light receiving windows are completely shielded with the recording paper. Positions of the lateral edges are determined from the difference between output signals of the two phototransistors. When printing the second recording paper, the first light receiving windows are shielded by light-tight shielding stickers.

13 Claims, 9 Drawing Sheets

PAPER LATERAL EDGE DETECTOR FOR PRINTER

BACKGROUND OF THE INVENTION

1. Field of the Invention

The present invention relates to a paper lateral edge detector, and more particularly, relates to a printer for forming a full-width print.

2. Explanation of the Prior Art

Recently, a digital camera is widely available. A user uses an image taken by the digital camera for a print by a color printer, additionally, for an observation on such as a personal computer. In the color printer, it is desirable to form a print without a margin surrounding the image, so-called a full-width print or non-margin print.

There are various types of color printers, such as an ink jet type, a thermal printing type, and a heat transfer type. For example, in a color thermal printer, a color thermal recording paper (hereinafter referred to as only a recording paper) having a yellow thermal coloring layer, a magenta thermal coloring layer, and a cyan thermal coloring layer is used. A light emitting element array on a thermal head is pressed to the recording paper during transport there of, and three colors of the thermal coloring layers are developed in sequence, to form a full color image on the recording paper.

Considering positional deviation and skewing in a widthwise direction of the recording paper when forming a non-margin print by the color thermal printer, the light emitting element array which is larger than recording paper in width is used. Moreover, when heat emitting elements not in contact with the recording paper are driven, waste heating occurs, so that it shortens useful life of the heat emitting elements. JPA No.9-272217 discloses a color thermal printer, in which the recording paper is prevented from skewing, to transport the recording paper in a straight line. Moreover, the lateral edge of the recording paper is detected by a CCD line sensor, to prevent waste heating of the heat emitting elements not in contact with the recording paper.

The aforementioned color thermal printer disposes the CCD line sensor upstream of a thermal head. The thermal head is extended in a sub scan direction, that is also a transporting direction of the recording paper. Accordingly, the lateral edge of the recording paper is detected at a considerable distance from a recording position where the heat emitting element array and the recording paper contact. In skewed manner of the recording paper, there is no coincidence in the lateral edges between a detecting position detected by the CCD line sensor and the recording position of the thermal head. Accordingly, in a non-margin print, there occurs a white stripe in the vicinity of the lateral edge and waste heating of the heat emitting elements. In a margin print, width thereof is not rendered uniform.

It is possible to principally solve the problem by disposing the CCD line sensor as near the heat emitting elements as possible. However, it is difficult to dispose the CCD line sensor very near the heat emitting elements since both the CCD line sensor and the thermal head have a size to some extent. If the CCD line sensor is disposed near the heat emitting elements, it causes a problem that output signal from the CCD line sensor is likely to become unstable according to a heating state of the heat emitting element array. Moreover, the CCD line sensor is relatively costly, thereby to increase manufacturing cost of the printer.

SUMMARY OF THE INVENTION

An object of the present invention is to provide a paper lateral edge detector, which can be disposed near a recording position.

Another object of the present invention is to provide a lateral edge detector for a recording paper, with a simple structure, which enables detection of a high precision.

Still another object of the present invention is to provide a lateral edge detector for a recording paper, which prevents heat damage by a thermal head.

To attain the above objects, the paper lateral edge detector of the present invention is provided with first and second photo sensors. The first photo sensor measures quantity of light passing through a light-receiving window partially shielded by the lateral edge of the recording paper. The second photo sensor is disposed away from the first photo sensor in the widthwise direction of the recording paper. The second photo sensor measures quantity of light in a light-shielded manner, to output dark current. A judging means judges the position of the lateral edge of the recording paper from the difference signal between output signals of the first and second photo sensors.

The first and second photo sensors are attached to a recording head. A paper guide is mounted to the recording head for guiding the recording paper, on which the light-receiving window is formed.

According to the preferred embodiment of the present invention, the printer enables to print first and second recording papers. The first recording paper is larger than the second recording paper in width. The first photo sensor measures quantity of light passing through the first light-receiving window disposed to cross the lateral edge of the first recording paper. The second photo sensor measures quantity of light passing through the second light-receiving window disposed to cross the lateral edge of the second recording paper. The recording head is driven for printing on either the first or second recording papers on a line-by-line basis in a widthwise direction of the recording paper. The recording head is larger than the first recording paper in width. A shielding means shields the second light-receiving window when printing the first recording paper, and shields the first light-receiving window when printing the second recording paper. A thermal printer includes a thermal head on which a plurality of heat emitting elements is aligned.

According to the present invention, the paper lateral edge is detected by the photo sensors, thereby to reduce cost. Moreover, the photo sensor can be attached to the recording head due to its small size, so that it enables to detect the paper lateral edge near the recording position. Furthermore, the lateral edge of the recording paper is found from the difference signals between the first and second photo sensors by using the second photo sensor which detects dark current in addition to the first photo sensor which detects the paper lateral edge, thereby to prevent damage by thermal drift.

According to the present invention, a white stripe on the lateral edge is prevented in a full-width print or a non-margin print and the width of the margin is rendered uniform in a margin print since the paper lateral edge is correctly measured. Moreover, if there occurs positional deviation of the recording paper in a main scan direction, it is possible to print an image on the recording paper in a manner that the center of the image is made to coincide with that of the recording paper in a main scan direction. Therefore, the incomplete printing of the image can be prevented, resulting in improved printing quality. Furthermore, the heat emitting elements can be protected from shortening its useful life since it is possible to prevent waste heating of the recording paper.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
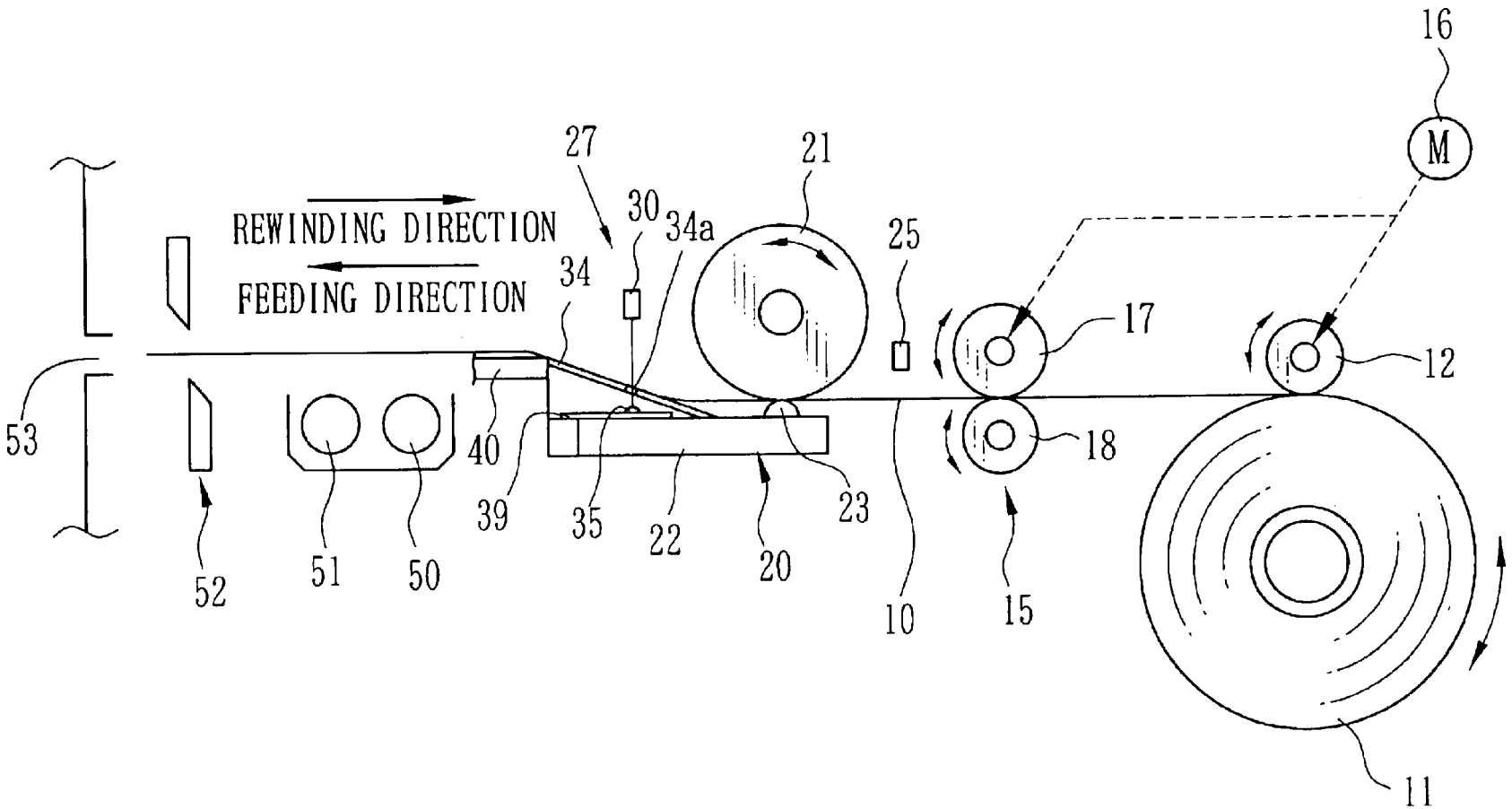
FIG. 1 is a schematic diagram illustrating a color thermal printer of the present invention.

In FIG. 1, a color thermal printer is loaded with a roll 11 of long thermal recording paper 10 being wound. The roll 11 is rotated by a supply roller 12 abutting on the perimeter of the roll 11, to feed or rewind the recording paper 10.

It is well known that the recording paper 10 includes a cyan thermal coloring layer, a magenta thermal coloring layer, and a yellow thermal coloring layer, overlaid on a support in sequence on one another. The yellow thermal coloring layer as a topmost layer, which is highest in heat sensitivity among three thermal coloring layers, is colored yellow with small heat energy. The cyan thermal coloring layer as a lowermost layer, which is lowest in heat sensitivity among three thermal coloring layers, is colored cyan with large heat energy. The yellow thermal coloring layer loses its coloring ability when near ultraviolet rays are irradiated in a wavelength region in which the peak value is 420 nm. The magenta thermal coloring layer is colored with medium-heat energy between the yellow and cyan thermal coloring layers and loses its coloring ability when near ultraviolet rays are irradiated in a wavelength region in which the peak value is 365 nm.

A carrying roller couple 15 is disposed downstream of the roll 11 in a feeding direction, for pinching and transporting the recording paper 10. The carrying roller couple 15 consists of a capstan roller 17 and a pinch roller 18.

The capstan roller 17 is rotated by a transporting motor 16. The pinch roller 18 is shiftable between the pressed position on the capstan roller 17 and the separated position from the capstan roller 17. The recording paper 10 is reciprocally transported between feeding and rewinding (printing) directions by the carrying roller couple 15.

Figure 2:
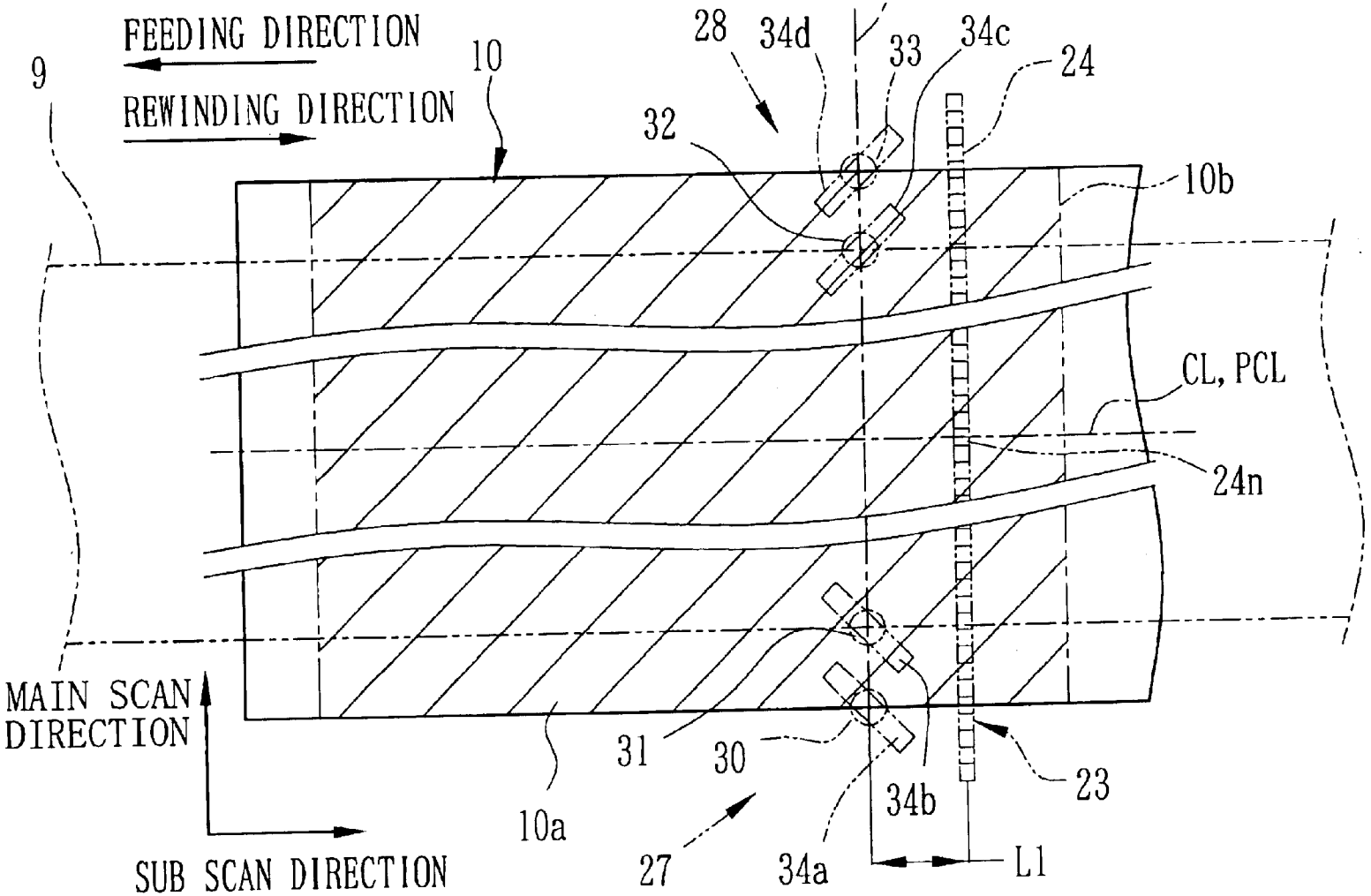
FIG. 2 is an explanatory view illustrating a position of a heat emitting element array.

A thermal head 20 and a platen roller 21 are disposed downstream of the carrying roller couple 15 in a feeding direction, to pinch a transporting path of the recording paper 10. The thermal head 20 includes a thermal head substrate 22 formed of metal having high thermal conductivity, to which a ceramic plate (not shown) is attached. A heat emitting element array 23 and a head driver 67 (shown in FIG. 6) are formed on the ceramic plate. In FIG. 2, the heat emitting element array 23 has many heat emitting elements 24 which are aligned along a main scan direction perpendicular to a transporting direction (sub scan direction) of the recording paper 10. The heat emitting element array 23 has enough length to cover the width of the recording paper 10 since printing is performed on a whole range of the recording paper 10.

The platen roller 21, slidable in a vertical direction, is biased by a spring (not shown) in a direction of being pressed on the thermal head 20. Each of the heat emitting elements 24 is heated depending upon a thermal coloring layer and the image data to be recorded, to print one of three primary colors on the recording paper on a line-by-line basis. The platen roller 21 rotates by following the transport of the recording paper 10.

An end-detecting sensor 25 is disposed between the carrying roller couple 15 and the platen roller 21, for detecting the distal end of the recording paper 10 during paper transport. The end-detecting sensor 25 is, for example, a photo interrupter which includes a projection area for irradiating inspection light to the distal end of the recording paper 10 and a receiving area for receiving inspection light reflected to the recording paper 10.

Figure 3:
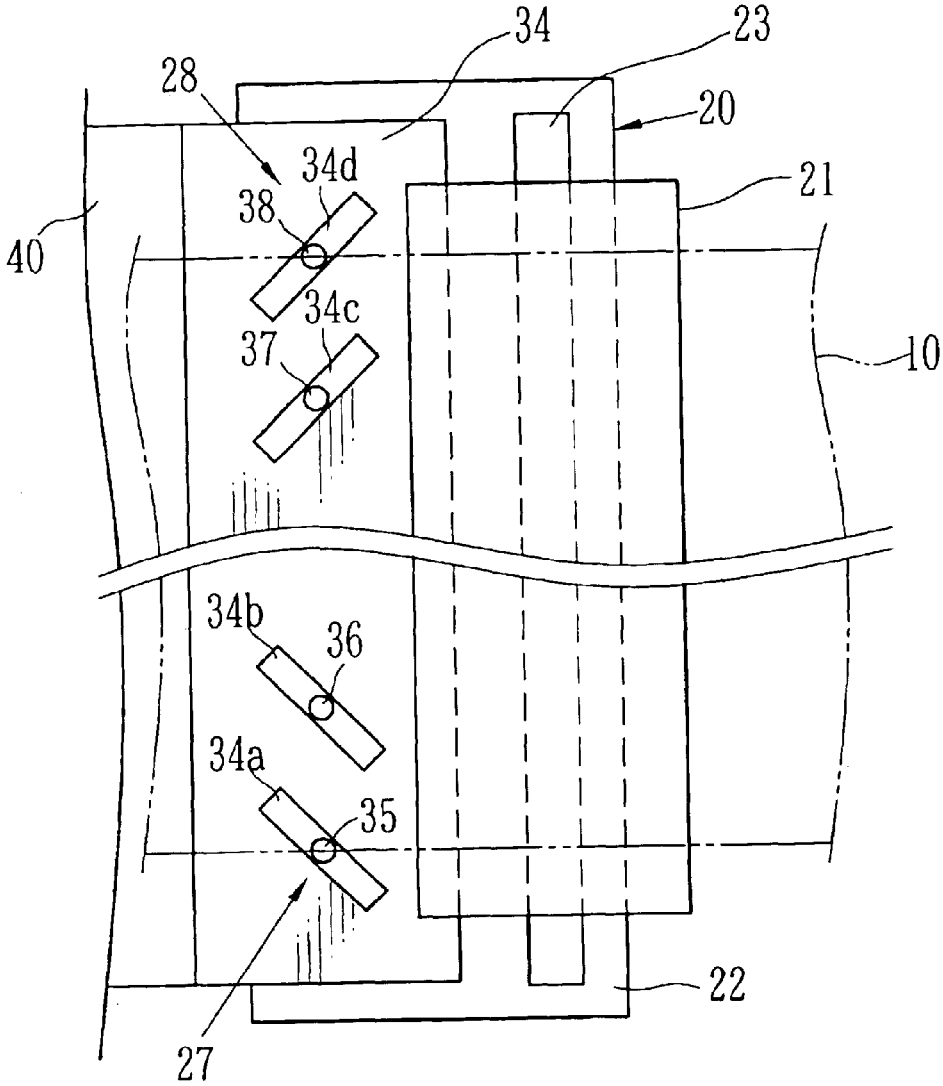
FIG. 3 is a plane view illustrating a thermal head and the peripheral thereof.
Figure 4:
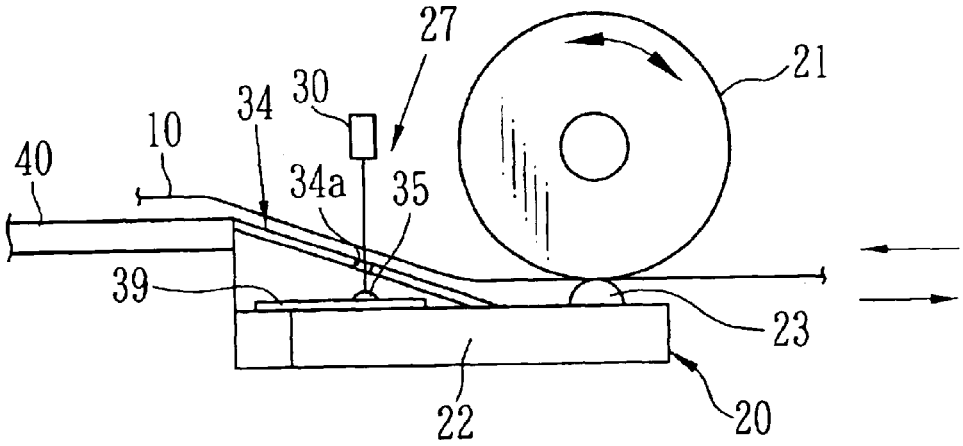
FIG. 4 is a side view illustrating a thermal head and the peripheral thereof.

In FIGS. 2 to 4, photo sensors 27 and 28 (hereinafter referred to as paper lateral edge detecting sensors) are provided upstream of the heat emitting element array 23 in an rewinding direction, also near the heat emitting element array 23, for detecting both lateral edges of the recording paper 10. The paper lateral edge detecting sensors 27, 28 are disposed asymmetric with respect to a centerline (CL) which shows a central position of the transporting path in a main scan direction.

Figure 5:
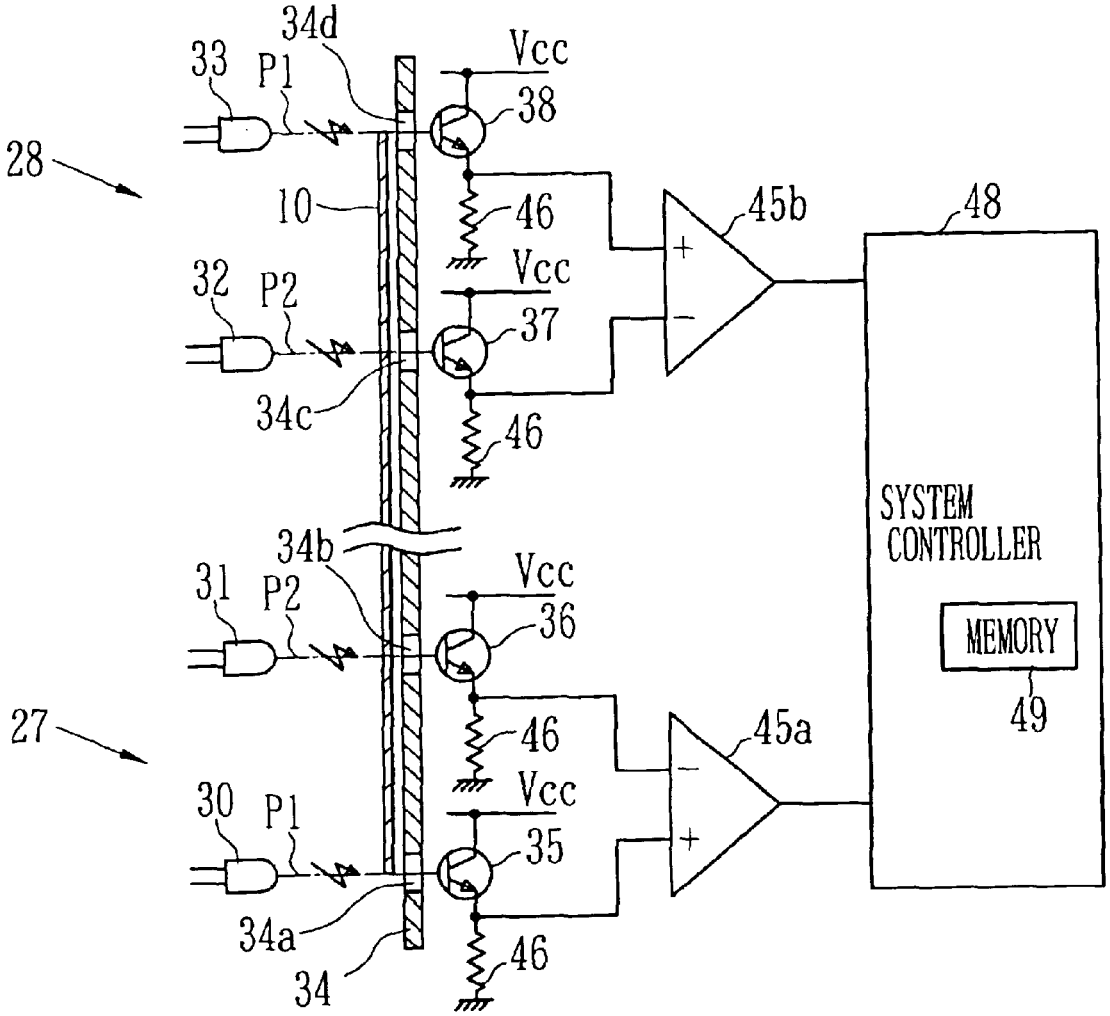
FIG. 5 is a schematic circuit diagram illustrating a paper lateral edge detector of the present invention.

In FIG. 5, the paper lateral edge detecting sensor 27 as a first sensor consists of light emitting diodes (LED) 30, 31 as a projector, phototransistors 35, 36 as a light receiver, light receiving windows 34*a*, 34*b*, and an amplifier 45*a*. The light emitting diodes (LED) 30, 31 are preferably infrared light-emitting diodes (IRED) which emit infrared rays since the recording paper 10 is fixative by ultraviolet rays. The paper lateral edge detecting sensor 28 as a second sensor consists of light emitting diodes (LED) 32, 33 as a projector, phototransistors 37, 38 as a light receiver, light receiving windows 34*c*, 34*d*, and an amplifier 45*b*.

The light receiving windows 34*a* to 34*d* are formed on a head cover 34. LEDs 30, 33 and photo transistors 35, 38 are provided at P1 (first positions) on which both lateral edges of the recording paper 10 pass. LEDs 31, 32 and phototransistors 36, 37 are provided at P2 (second positions). P2 are aligned with P1 on line L2 (see FIG. 2) in parallel with widthwise direction of the recording paper, and arranged inner of P1.

Figure 9:
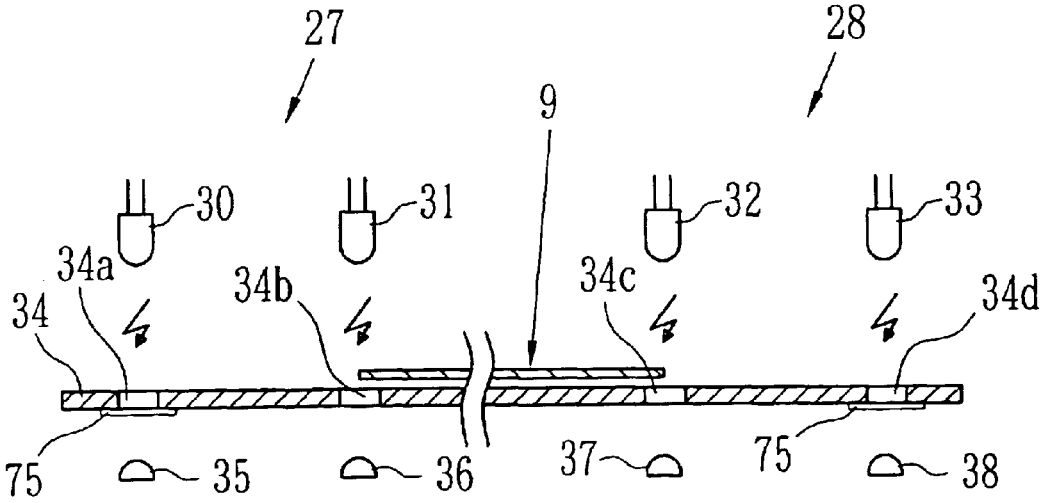
FIG. 9 is a cross sectional view illustrating a manner that a first light receiving window is shielded for printing on a recording paper having a narrow width.

It is possible for the color thermal printer to print the king-sized recording paper 10 and large-sized recording paper 9 (see FIGS. 2 and 9). The recording paper 10 is larger than the recording paper 9 in width. In order to detect the lateral edge position of the recording paper 9 which is narrower than the recording paper 10 in width, P2 is adjusted to cross the lateral edges of the recording paper 9.

In FIG. 4, the phototransistors 35 to 38 are attached to a circuit board 39 fixed to the thermal head substrate 22. Note that the phototransistors 35 to 38 may be attached to the ceramic plate provided with the heat emitting element array 23.

The inclined head cover 34 is attached to the thermal head 20 so as to direct the recording paper 10 passed through a paper guide cover 40 to the heat emitting element array 23. The head cover 34 has a function of protecting such as a head driver 67 formed on the ceramic plate, in addition to a function of paper guide. The head cover 34 covers the phototransistors 35 to 38 and are made of a metallic plate such as aluminum plate.

The head cover 34 has the light receiving windows 34*a* to 34*d* which are respectively positioned corresponding to the phototransistors 35 to 38 on P1 and P2. The light receiving windows 34*a* to 34*d* are, for example, slits crossed at an angle of 45 degree to the lateral edge of the recording paper 10 and guides light emitted from LEDs 30 to 33 to the phototransistors 35 to 38. As shown in FIG. 2, the light receiving windows 34*a* to 34*d* are formed linearly symmetric with respect to a centerline (CL) of the transporting path and have enough length to cover traveling deviation of the recording papers 9, 10. The center of the light receiving windows 34*a* to 34*d* is found by a mean value of the paper lateral edges during transport thereof.

Thus, paper lateral edges are detected by using the phototransistor, so that the printer of the present invention is smaller in size than that of using a CCD line sensor, to shorten the interval (L1) between printing position by heat emitting element array 23 and detecting position by paper lateral edge detecting sensors 27, 28. Therefore, it is possible to detect the paper lateral edges near the heat emitting element array 23 and to obtain more precise information of the lateral edges.

As shown in FIG. 2, the number of pixels of the images recorded within range of a recording area 10*a* of the recording paper 10 is, for example, 1024 in the sub scan direction (L) and 768 in the main scan direction (W). This means that printing for 1024 lines is performed by the 768 heat emitting elements 24. Note that the actual number of the heat emitting elements 24 on the heat emitting element array 23 is 768+$\alpha$. $\alpha$ is the number of the additional heat emitting elements in order to extend the length of the heat emitting element array 23 in a main scan direction longer than the width of the recording paper 10 considering transporting deviation and skewing of the recording paper 10 in a main scan direction. Practically, $\alpha$ elements in use are several tens of elements.

As shown in FIG. 5, in the paper lateral edge detecting sensor 27 as a first sensor, output signal from the phototransistors 35, 36 for detecting lateral edge position of the recording paper 10 is divided by a voltage-dividing resistor 46 to be transferred to each terminal of the amplifier 45*a*. Since the phototransistor 36 at the second position is covered with the recording paper 10 as a shielding means, the phototransistor 36 outputs dark current under same environment as the phototransistor 35. The amplifier 45*a* amplifies the difference signal between the phototransistors 35 and 36. Accordingly, even when temperature change occurs on the basis of driving of the heat emitting array, the paper lateral edge senso768 r 27 can obtain output signal corresponding to positional deviation of the recording paper 10. The phototransistors 35, 36 are respectively located at a same distance from the heat emitting element array 23, thereby to receive the same amount of heat. Accordingly, thermal drift is cancelled by calculating the output difference between the phototransistors 35, 36. Also in the paper lateral edge detecting sensor 28 as a second sensor, thermal drift is cancelled in a similar manner to the paper lateral edge detecting sensor 27.

The output signal from the amplifiers 45*a*, 45*b* are transferred to a system controller 48. Table data is memorized in a memory 49 of the system controller 48, and represents shows a relation between output signal of the amplifiers 45*a*, 45*b* and the centerline (PCL) of the recording paper 10. By referring to the table data, the central position data of the recording paper is calculated by output signal of the amplifiers 45*a*, 45*b*. The table data is calculated in advance by using an actual machine. The heat emitting elements 24 used for printing are determined according to the central position data and the paper width. Moreover, pixel lines are associated with each of heat emitting elements so that a center of the heat emitting elements is in accordance with that of the image. Furthermore, it is also possible from two lateral edge positions to determine the heat emitting elements 24 used for printing, by using the data which is for conversion into the lateral edge position on the heat emitting elements 24 from the positional information of the lateral edges position.

A yellow-fixing lamp 50 and a magenta-fixing lamp 51, constituting an optical fixing device, are disposed downward of the thermal head 20 in a feeding direction. The yellow-fixing lamp 50 irradiates near ultraviolet rays, the peak value of which is 420 nm, to fix the yellow thermal coloring layer on the recording paper 10. The magenta-fixing lamp 51 irradiates near ultraviolet rays, the peak value of which is 365 nm, to fix the magenta thermal coloring layer on the recording paper 10. A cutter 52 is disposed downstream of the thermal head 20 in a feeding direction, for cutting the long recording paper 10 by each recording area. A printer housing (not shown) has a sheet discharge opening 53, to discharge a separated print sheet.

Figure 6:
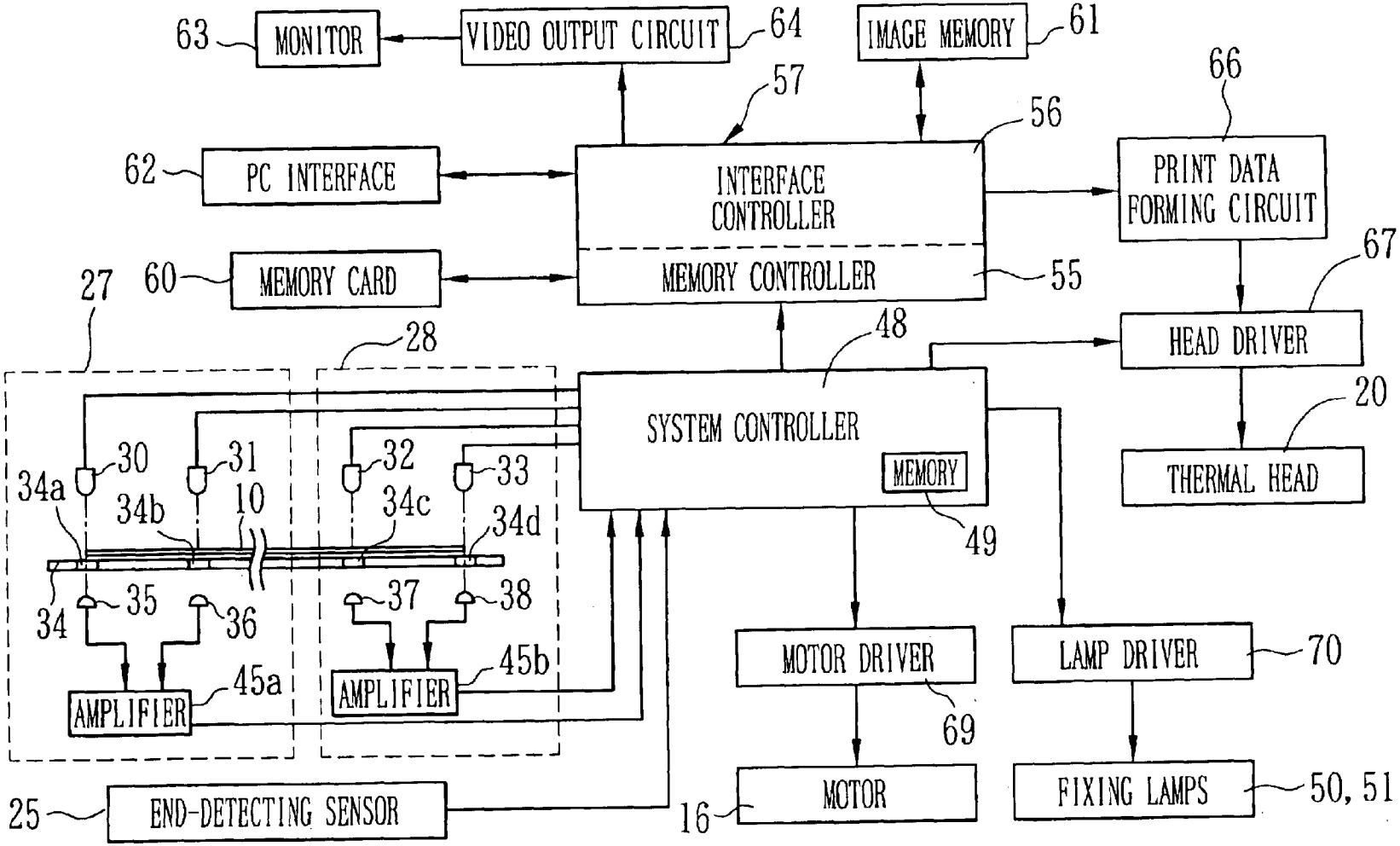
FIG. 6 is a block diagram illustrating an electrical configuration of the color thermal printer.

In FIG. 6, the system controller 48 controls each part of the color thermal printer. The system controller 48 includes, for example, a CPU, program ROM and the memory 49 such as work RAM. The CPU controls each part of the color thermal printer according to a control program memorized in program ROM. Temporary data occurred during control is memorized in work RAM.

An IC 57 is connected to the system controller 48. A memory controller 55 and an interface controller 56 are packaged in the IC 57. The memory controller 55 controls a memory card 60 loaded in a memory card slot (not shown) and image memory 61, to read and write the image data. The interface controller 56 controls a PC interface 62 and a video output circuit 64. The PC interface 62 is used for connecting to a personal computer and a digital camera, and the video output circuit 64 is used for outputting the image to an external monitor 63.

When displaying the image memorized in the memory card 60 to the external monitor 63, the memory controller 55 reads the image data from the memory card 60. The image data is transferred to the video output circuit 64 by an interface controller 56. The video output circuit 64 converts the image data of RGB into a composite signal such as NTSC, to transfer it to the external monitor 63.

When printing the image memorized in the memory card 60, the memory controller 55 reads the image data from the memory card 60, to write the image data on the image memory 61. The memory controller 55 reads the image data from the image memory 61, to transfer it to a print data forming circuit 66.

The print data forming circuit 66 converts the image data (red, green and blue image data) into the print data (yellow, magenta and cyan image data). Print data having a color to be printed is transferred to a head driver 67 on a line-by-line basis. The head driver 67 converts the print data of one line into a driving signal to drive each of the heat emitting elements 24 of the thermal head 20.

A motor driver 69 and a lamp driver 70 are connected to the system controller 48. The motor driver 69 generates a driving pulse for driving the motor 16 as a stepping motor, by a control signal from the system controller 48. The driving pulse generated by the motor driver 69 is counted at the system controller 48, to be used for detecting the transporting amount of the recording paper 10.

The lamp driver 70 responsive to control signals from the system controller 48 lights on or off the yellow-fixing lamp 50 and the magenta-fixing lamp 51, to fix the yellow thermal coloring layer and the magenta thermal coloring layer.

The paper lateral edge detecting sensors 27, 28 are controlled by the system controller 48. In the system controller 48, the lateral edge position of the recording paper 10 in a main scan direction is found based on the signals from the amplifiers 45*a*, 45*b*, to determine the heat emitting elements 24 to be driven at the head driver 67.

Figure 7:
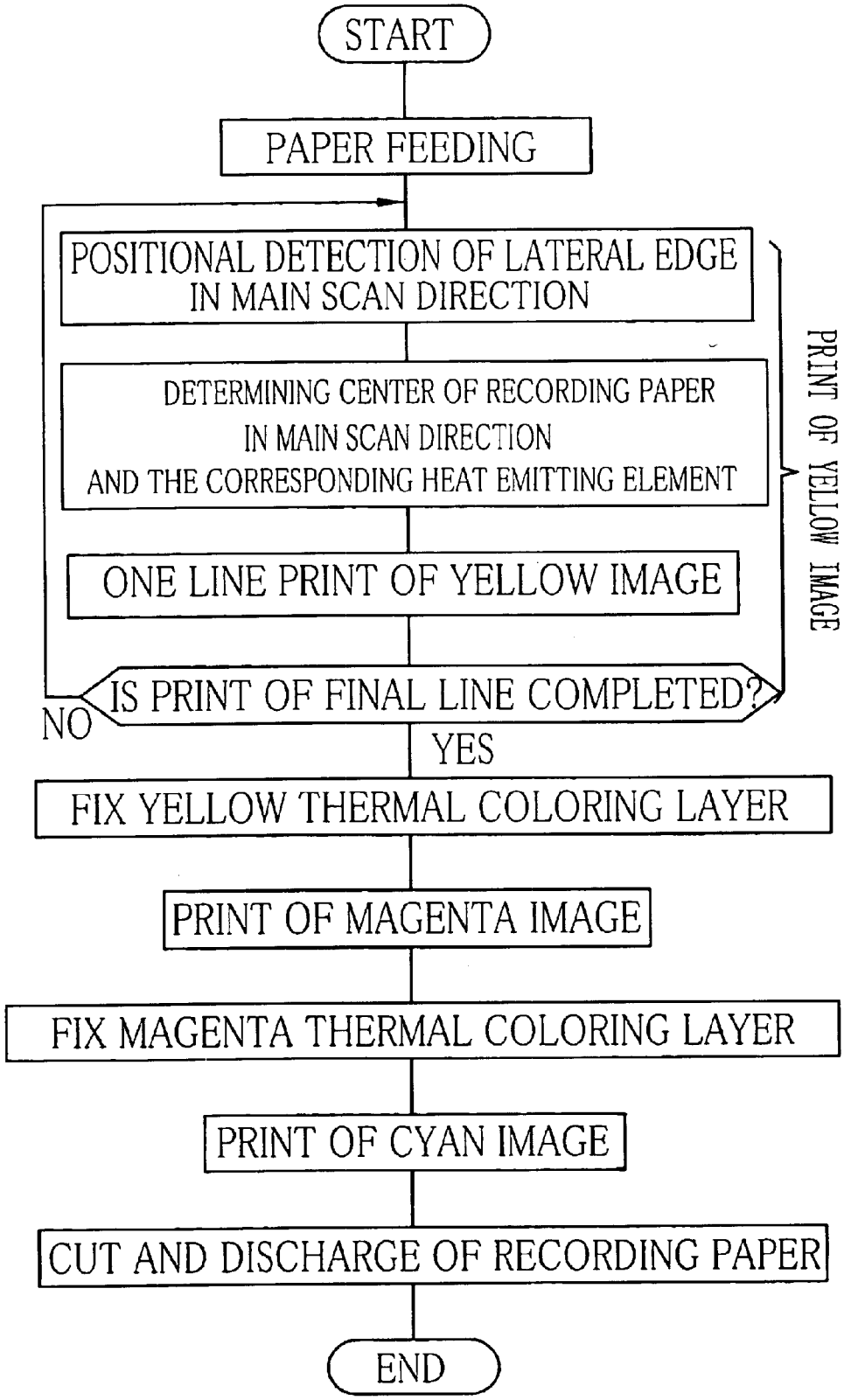
FIG. 7 is a flow chart illustrating printing operation.

Next, the operation of the above embodiment will be explained by referring to a flowchart in FIG. 7.

A plurality of thumbnail images stored in the memory card 60 is read by the memory controller 55. Data of the plurality of thumbnail images is transferred to the monitor 63 via the video output circuit 64 in a matrix manner. A user observes the monitor 63 to select the image to be printed. The memory controller 55 reads the selected image out of the memory card 60, to write in the image memory 61.

When printing is instructed, the system controller 48 controls the motor driver 69 and starts rotation of the motor 16. In FIG. 1, the motor 16 rotates the supply roller 12 in the counterclockwise direction. The supply roller 12 rotates the roll 11 to feed the end of the recording paper 10.

When the end of the recording paper 10 reaches between the capstan roller 17 and the pinch roller 18, the end-detecting sensor 25 transfers the detected signal to the system controller 48. When receiving the detected signal of the end-detecting sensor 25, the system controller 48 starts counting of the driving pulse of the motor 16. According to count of the driving pulse, the transporting amount of the recording paper 10 is measured.

When it is judged according to the number of the pulses that a first line 10*b* on the recording area 10*a* (a hatched portion in FIG. 2) of the recording paper 10 reaches the detected position detected by the paper lateral edge detecting sensors 27, 28, the controller 48 discontinues the rotation of the motor 16, thereby completing the transport of the recording paper 10.

The pinch roller 18 is moved by a shift mechanism (not shown) during discontinued transport of the recording paper 10, to pinch the recording paper 10 with the capstan roller 17. The platen roller 21 is moved by the shift mechanism (not shown) to pinch the recording paper 10 with the heat emitting element array 23.

The system controller 48 lights on the LEDs 30 to 33 of the paper lateral edge detecting sensors 27 and 28, to start detecting the lateral edges of the recording paper 10. The amplifiers 45*a*, 45*b* calculate the difference signal between the photo transistors 35 and 36, and between the phototransistors 37 and 38 respectively. The system controller 48 determines both lateral edge positions of the first line 10*b* in a main scan direction based on the difference signal between the amplifiers 45*a*, 45*b*. The system controller 48 accordingly determines the centerline (PCL) of the recording paper 10 in a main scan direction, to determine the heat emitting element 24*n* corresponding to the centerline (PCL).

Figure 8:
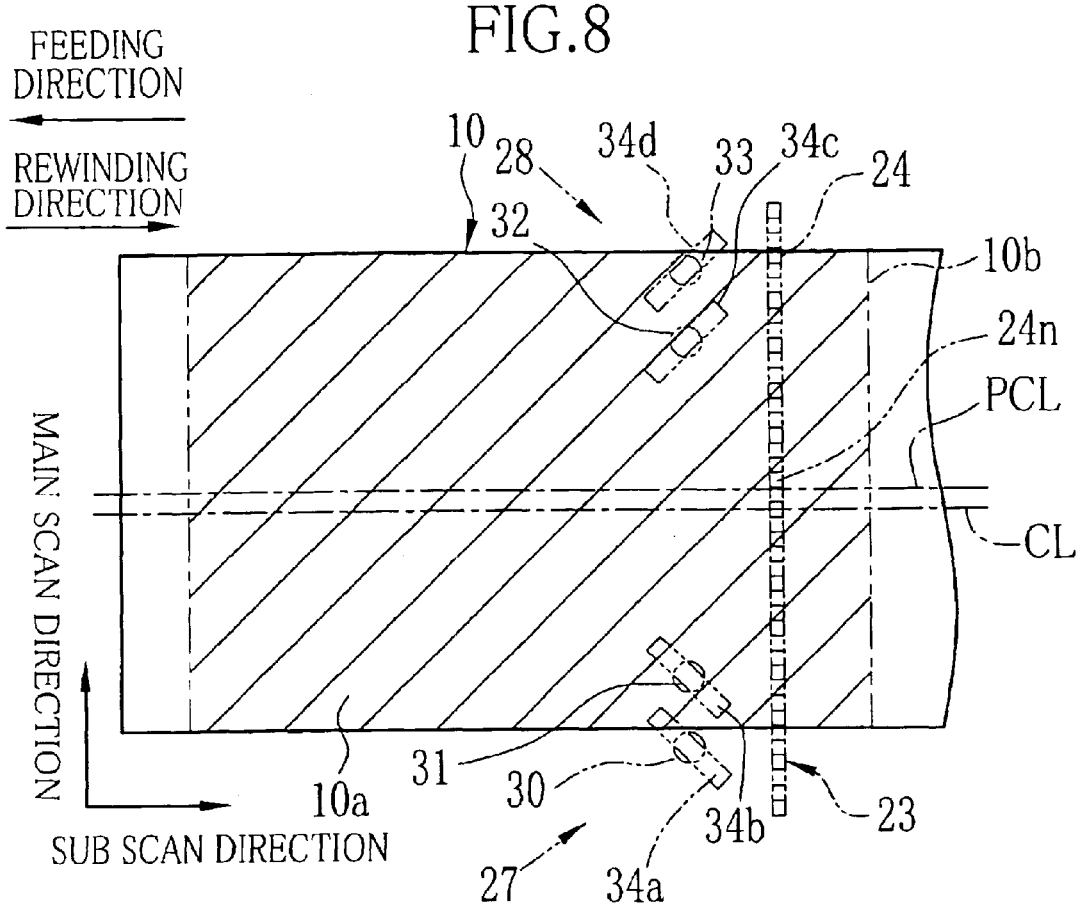
FIG. 8 is an explanatory view illustrating a manner that a recording paper is deviated from the correct position during transport thereof.

As shown in FIG. 2, the centerline (CL) of the transporting path is coincident with the centerline (PCL) of the recording paper if there is no positional deviation of the recording paper 10 in a paper width direction. In this case, a center of heat emitting elements on the heat emitting element array 23 is the heat emitting element 24*n* which corresponds to the centerline (PCL). As shown in FIG. 8, if there is positional deviation of the recording paper 10 to the side of the paper lateral edge detecting sensor 28 during transport thereof, the heat emitting element 24*n* corresponding to the centerline (PCL) also deviates to the side of the paper lateral edge detecting sensor 28 from the centerline (CL) of the transporting path.

The system controller 48 transfers positional information of the centerline (PCL) to the memory controller 55. The memory controller 55 reads the image data from the image memory 61 so as to allocate a pixel of the yellow image placed on its centerline in a main scan direction to the heat emitting element 24*n* corresponding to the centerline (PCL) of the recording paper 10 in a main scan direction.

The image data read from the image memory 61 is transferred to the print data forming circuit 66. The image data of RGB is converted into the print data of YMC. After conversion, print data for the first line of the yellow image is read and transferred to the head driver 67. The head driver 67 converts the print data for the first line into the driving signal, to drive each of the heat emitting elements 24, thereby to print the first line of the yellow image on the recording paper 10. After printing of the first line of the yellow image is completed, the motor 16 rotates backwards at predetermined steps, to transport the recording paper 10 of one line in a rewinding direction.

With reference to print of the first line, the system controller 48 determines whether each the heat emitting elements should generate heat or not, based on the positional information of both lateral edges, to transfer either drive disabling signal or drive permitting signal, allocated to each the heat emitting elements, to the head driver 67. The head driver 67 drives only heat emitting elements permitted to generate heat. Accordingly, there are no heat emitting elements driven outside of the lateral edges of the recording paper 10.

The aforementioned procedure is repeated, so that a second line of the yellow image is recorded on the recording paper 10. By repeating print of one line and transport of the recording paper 10, the yellow image is printed within the recording area 10*a*. Actually, the motor 16 is continuously rotated. Simultaneously, the heat emitting element array 23 is driven to print one line of the yellow image every transport of the recording paper 10 on a line-by-line basis.

Also in the print of the second line and the following lines of the yellow image, both lateral edges of the recording paper 10 are detected every transport of the recording paper 10 on a line-by-line basis. Based on positional information of both lateral edges, the heat emitting elements used for printing are determined, and reading the image data from the image memory 61 is controlled.

When printing the yellow image is completed, the system controller 48 moves the platen roller 21 to release the pressure of the recording paper 10 to the thermal head 20. Next, the system controller 48 starts anti-reverse of the motor 16 to transport the recording paper 10 in a feeding direction. The yellow fixing lamp 50 lights on via the lamp driver 70 simultaneous with start of the transport of the recording paper 10, to fix the heated yellow thermal coloring layer. When the yellow thermal coloring layer is completely fixed by entirely irradiating ultraviolet rays to the recording area 10*a*, the system controller 48 discontinues the transport of the recording paper 10 to lights off the yellow fixing lamp 50.

Next, the system controller 48 transports the recording paper 10 in a rewinding direction. When the first line 10*b* on the recording are a 10*a* reaches printing position of the heat emitting element array 23 on the thermal head 20, the transport of the recording paper is discontinued.

As mentioned above, the platen roller 21 is moved downward to press the recording paper 10 to the thermal head 20. The magenta image is printed on line-by-line basis during the transport of the recording paper 10 in a rewinding direction. Again, lateral edges of the recording paper 10 are detected, heat emitting elements used for printing are determined, and the centerline (PCL) of the recording paper 10 is adjusted to that of the image.

When printing of the magenta image is completed, the magenta-fixing lamp 51 lights on, to fix the heated magenta thermal coloring layer during rewinding of the recording paper 10. Thereafter, printing of the cyan image is also performed in a similar manner, in which both lateral edges of the recording paper 10 are detected, heat emitting elements used for printing are determined, and the centerline (PCL) of the recording paper is adjusted to that of the image.

When printing of the cyan image is completed, the recording paper 10 is transported in a feeding direction to be cut into a sheet by the cutter 52. The sheet-shaped recording paper is discharged outside the color-heating printer from the sheet discharge opening 53.

Although the lateral edges are detected each line in this embodiment, the lateral edges may be detected each several lines or tens of lines. Moreover, lateral edges may be detected only at the start of recording each color image if meandering does not occur. The light receiving windows 34*b*, 34*c* arranged inwardly, as a second combination corresponding to the phototransistors 36, 37 are shielded by the recording paper 10. However it may be shielded by a shielding sticker.

The thermal printer can be used for printing on the large-sized recording paper 9 in addition to the king-sized recording paper 10. In this case, the light receiving windows 34*a*, 34*d* arranged outwardly as a first combination are covered with light-tight shielding stickers 75 as shown in FIG. 9. Accordingly, the paper lateral edge detecting sensors 27, 28 corresponding to the large-sized recording paper 9 become effective.

Figure 10A:
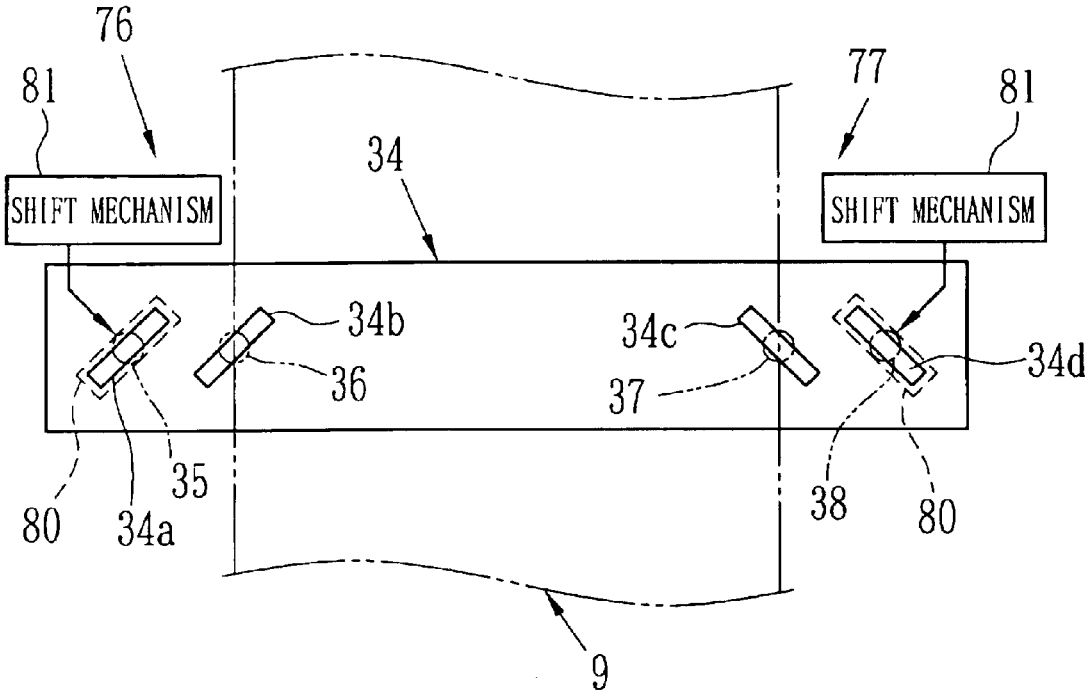
FIG. 10A is a plan view illustrating a manner that a shielding shutter covers a first light receiving window.
Figure 10B:
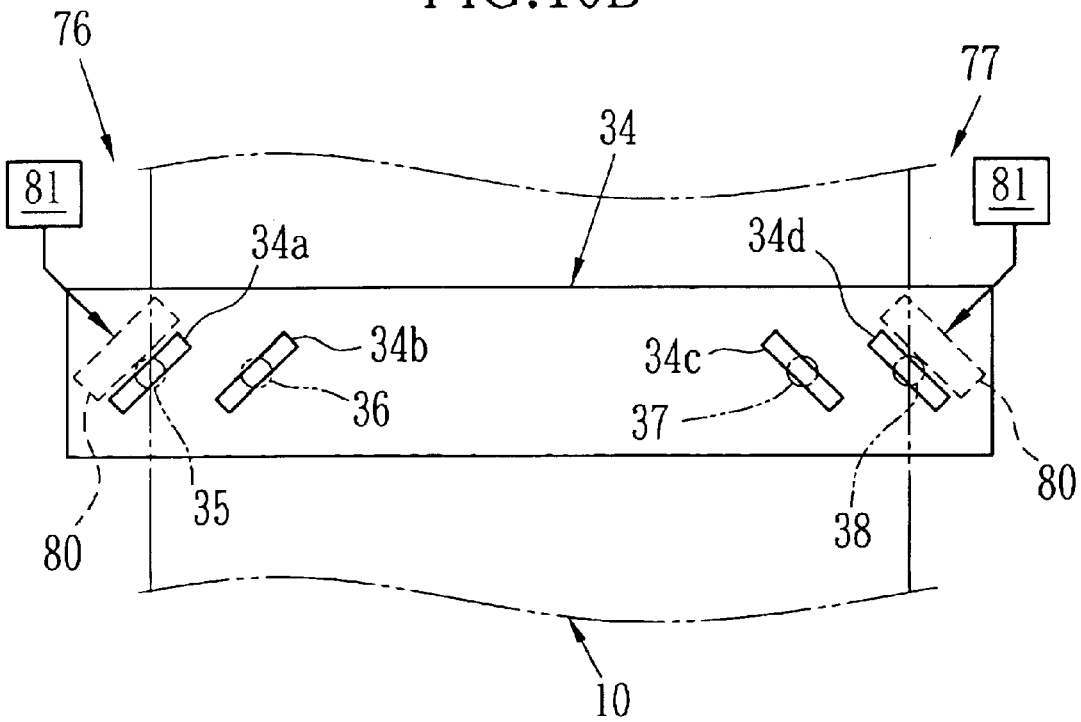
FIG. 10B is a plan view illustrating a manner that the shielding shutter uncovers the first light receiving window.

Incidentally, the receiving windows may be selected corresponding to the size of the recording paper used for printing, based on the size-changing signal of the recording papers 9, 10. In FIG. 10 showing the embodiments, the same reference numerals are used to designate the same or similar components as those in FIG. 3. The light receiving windows 34*a*, 34*d* arranged outwardly are opened and shut by a shielding shutter 80 which is shifted by a shift mechanism 81. In the large-sized recording paper 9 shown in FIG. 10A, the shift mechanism 81 is driven to slide the shielding shutter 80 to the closed position, to shut the first light receiving windows 34*a*, 34*d*. In the king-sized recording paper 10 shown in FIG. 10B, the shift mechanism 81 is driven to slide the shielding shutter 80 to the opened position. In printing on the king-sized recording paper 10, the second light receiving windows 34*b*, 34*c* are shielded by the recording paper 10. Note that the shielding shutter 80 may be moved with swing or rotation.

Figure 11:
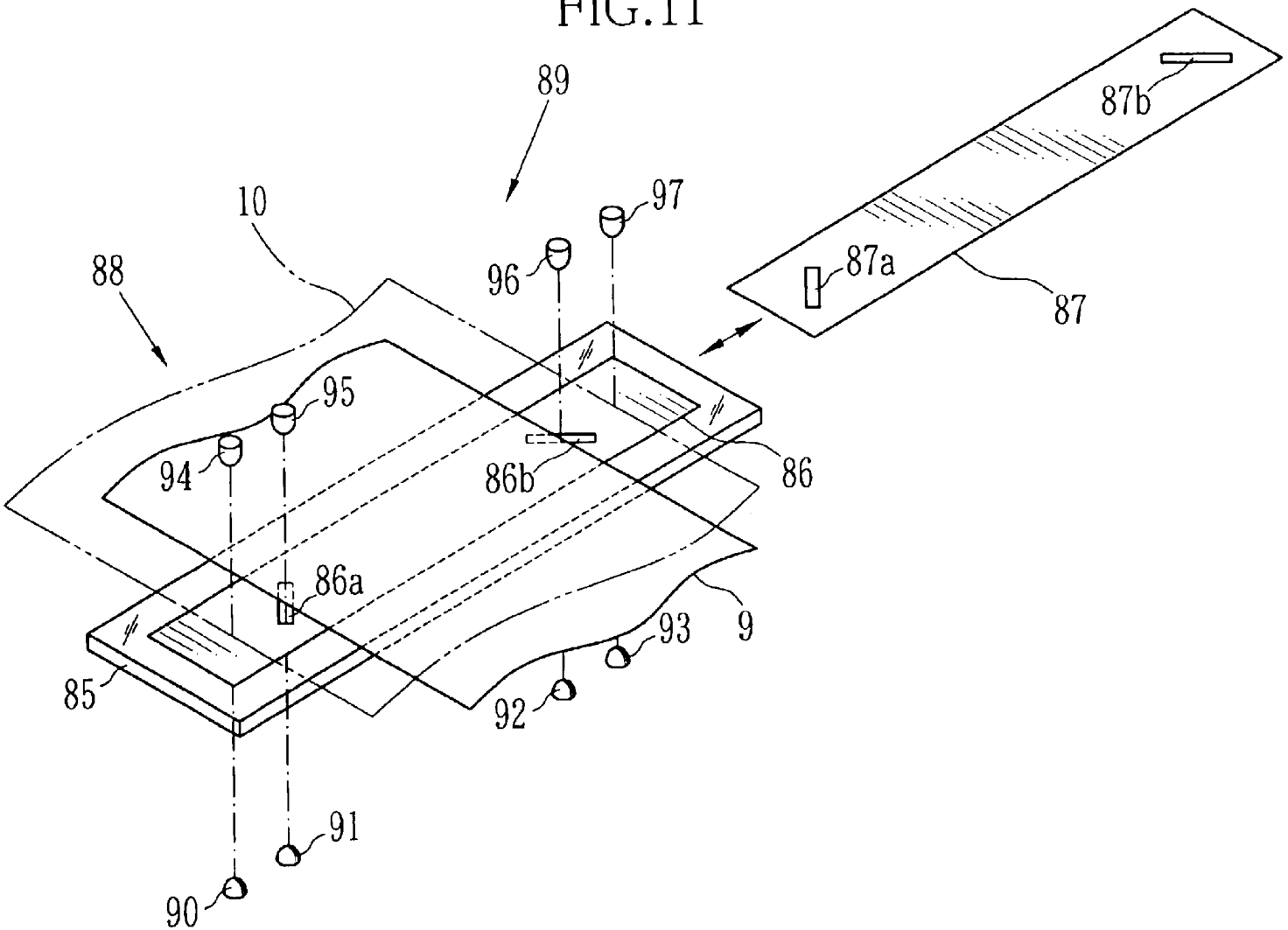
FIG. 11 is a perspective view of a main part illustrating an embodiment that two mask plates selectively covers the first and second light receiving windows.

In the embodiments shown in FIG. 11, a head cover 85 is made of a transparent material on which two types of mask plates 86, 87 are selectively set. The first mask plate 86 has light receiving windows 86*a*, 86*b* at the position corresponding to the phototransistors 91, 92. The second mask plate 87 has light receiving windows 87*a*, 87*b* at the position corresponding to the phototransistors 90, 93. Either of the mask plates 86, 87 is selected corresponding to size of the recording paper used for printing. The reference numerals 94 to 97 show LEDs. It is noted that the head cover may be made of opaque material such as a metal, and that openings may be formed to cross the lateral edges of the recording papers 9, 10, and that either of the mask plates 86, 87 may be attached to the head cover so as to close the openings.

Moreover, it is possible to provide memories for memorizing positional data of lateral edges of each line. The number of the memories corresponds to distance between the heat emitting element array 23 and the paper lateral edge detecting sensors 27, 28. When the measured lateral edges reach the heat emitting element array, driving of the heat emitting element array is controlled based on the corresponding positional data of the lateral edges. Furthermore, it may be possible to determine the position of lateral edges at a recording position based on the skew running of the recording paper based on the positional data of the lateral edges of each line, and distance between the heat emitting element array and the edge detecting sensors.

It may be possible to measure reflected light from the light receiving windows 34*a* to 34*d* in place of transmitted light. In this case, LEDs are provided on the side of phototransistors 35 to 38, to be projected toward the light receiving windows 34*a* to 34*d*.

Moreover, both lateral edges of the recording paper are detected according to the above-mentioned embodiments. However, only one lateral edge of the recording paper may be measured since the width of the recording paper is constant. In this case, it is possible to know position of the other lateral edge by adding paper width to position of one lateral edge. If one of the lateral edges is moved along a guide plate, it is sufficient to only search a position of the other lateral edge.

Three or more types of the recording papers may be used. In this case, light receiving windows, LEDs, and phototransistors are arranged at the position corresponding to the lateral edges of each type of the recording paper. An unrequired light-receiving window is shielded with a light-tight shielding sticker or a shutter.

The present invention is applicable not only to a color thermal printer of a one-head, three-pass type but also that of a three-head, one-pass type. Moreover, the present invention can be used for such as color thermal transfer printer, a color ink-jet printer, a laser printer, a copying machine, and other image forming apparatuses of various kinds. Furthermore, the present invention can be applicable to a web-conveying device. The recording head may be moved relative to the recording paper in stopping, in which the lateral edge detector is moved with the recording head.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A sheet lateral edge detector comprising:

a light receiving window having a region which a lateral edge of a recording sheet moves across;

a first photo sensor for measuring light passing through said light-receiving window partially shielded by said lateral edge of said recording sheet;

a second photo sensor disposed away from the first photo sensor in a widthwise direction of said recording sheet, for measuring dark current; and a judging device for judging the position of said lateral edge of said recording sheet from the difference signal between output signals of the first and second photo sensors.

2. A sheet lateral edge detector as claimed in claim 1, further comprising a recording head, for performing line print of the image on said recording sheet, wherein said first and second photo sensors are attached to said recording head, wherein said recording sheet is moved relative to said recording head.

3. A sheet lateral edge detector as claimed in claim 2, further comprising a head cover slantly attached to said recording head, for guiding said recording sheet, wherein said light receiving window is formed on said head cover.

4. A sheet lateral edge detector for a printer, said printer being capable of printing on first and second recording sheets, a width of said first recording sheet being larger than a width of said second recording sheet, said sheet lateral edge detector comprising:

a first light receiving window having a region while a lateral edge of said first recording sheet moves across during transport thereof;

a first photo sensor for receiving light passed through said first light receiving window partially shielded by said lateral edge of said first recording sheet;

a second light receiving window having a region which a lateral edge of said second recording sheet moves across during transport thereof;

a second photo sensor for receiving light passed through said second light receiving window partially shielded by said lateral edge of said second recording sheet;

a recording head for printing on said first or second recording sheet on line-by-line basis extending in said widthwise direction, said recording head having a length larger than said width of said first recording sheet;

a shielding device for shielding said second light receiving window in printing on said first recording sheet, and for shielding said first light receiving window in printing on said second receiving sheet; and a judging device for judging the position of said lateral edge of said first or second recording sheet from the difference signal between output signals of the first and second photo sensors.

5. A sheet lateral edge detector as claimed in claim 4, wherein said recording head is a thermal head on which a plurality of heat emitting elements are aligned.

6. A sheet lateral edge detector as claimed in claim 5, wherein said first and second photo sensors are aligned near said recording head and in parallel therewith.

7. A sheet lateral edge detector as claimed in claim 6, wherein said first and second light receiving windows are in a slit form inclined with respect to a direction of said transport of said first or second recording sheet.

8. A sheet lateral edge detector as claimed in claim 7, further including a head cover, secured by said thermal head, for guiding said first and second recording sheets, said first and second light receiving windows being formed on said head cover.

9. A sheet lateral edge detector as claimed in claim 8, wherein said first and second photo sensors are attached to said thermal head.

10. A sheet lateral edge detector as claimed in claim 9, wherein said first recording sheet is functioned as said shielding device in printing on said first recording sheet.

11. A sheet lateral edge detector as claimed in claim 10, further comprising a shielding shutter for opening and shutting said first light receiving window, functioned as said shielding device in printing on said second recording sheet.

12. A sheet lateral edge detector as claimed in claim 7, wherein said shielding device includes a first mask plate provided with said first light receiving window and a second mask plate provided with said second light receiving window, wherein said first mask plate is set between said first recording sheet and said first and second sensors in printing on said first recording sheet, wherein said second mask plate is set between said second recording sheet and said first and second sensors in printing on said second recording sheet.

13. A sheet lateral edge detector as claimed in claim 12, further comprising a head cover secured to said thermal head, for guiding said first and second recording sheets, said head cover having a transparent part for selectively setting said first and second mask plates.

* * * * *